United States Patent [19]

Yahata

[11] 4,369,529

[45] Jan. 25, 1983

[54] BELT WITH BUCKLE

[76] Inventor: Eiji Yahata, 1506-4, Oaza-chizu, Chizucho, Yazugun, Tottori, Japan

[21] Appl. No.: 211,570

[22] Filed: Dec. 1, 1980

[51] Int. Cl.[3] ..... A41F 3/00

[52] U.S. Cl. ..... 2/322; 24/163 K

[58] Field of Search ..... 2/322, 318, 338, 333, 2/325, 321; 24/73, 75, 77 R, 78, 163 R, 163 K

[56] References Cited

U.S. PATENT DOCUMENTS 3,112,496 12/1963 Dritz ..... 2/322

4,100,655 7/1978 Langley ..... 24/163 K

*Primary Examiner*—Doris L. Troutman

*Attorney, Agent, or Firm*—McGlew and Tuttle

[57] ABSTRACT

A belt with a buckle, which comprises a belt having a plurality of holes provided at proper intervals on its back side at its free end, each of the holes having an opening only on the back side of the belt, a base having a projection provided on its upper surface, to the left-hand end of which the other end of the belt is secured, a cover having a pair of sides bent downward, the cover being rotatably mounted on the base in such a manner that the head of the projection may abut against the back side of the cover and that the junction of the belt and the base may be positioned at the left-hand end on the back-side of the cover, and an adjusting belt having the same thickness as that of the belt, the adjusting belt being rotatably attached to the sides of the cover opposite to the base.

4 Claims, 7 Drawing Figures

BELT WITH BUCKLE

BACKGROUND OF THE INVENTION

The present invention relates to belts with buckles that are used for supporting clothes such as trousers, pants, and skirts.

Conventional belts with buckles can be classified into two types; one uses a combination of a hole opened in the belt and a pin fixed to the buckle to support clothes, and the other utilizes the friction caused between the belt and the buckle. The former has a poor appearance since the holes of the belt and the pin of the buckle are exposed. In the latter belt, holes need not be opened but it has a bulky buckle that is unstable on the belt since a friction piece must be incorporated in the buckle.

SUMMARY OF THE INVENTION

Accordingly, it is an object of the invention to provide a belt with a buckle that has neither holes nor pin exposed.

It is another object of the invention to provide a belt with a buckle that is stable on the belt.

According to the invention, there is provided a belt with a buckle, which comprises a belt having a plurality of holes provided at proper intervals on its back side at its free end, each of the holes having an opening only on the back side of the belt, a base having a projection provided on its upper surface, to the left-hand end of which the other end of the belt is secured, a cover having a pair of sides bent downward, the cover being rotatably mounted on the base in such a manner that the head of the projection may abut against the back side of the cover and that the junction of the belt and the base may be positioned at the left-hand end on the back-side of the cover, and an adjusting belt having the same thickness as that of the belt, the adjusting belt being rotatably attached to the sides of the cover opposite to the base.

BRIEF DESCRIPTION OF THE DRAWINGS

Further objectives and advantages of the invention will appear from the following detailed description of the embodiments thereof and from the accompanying drawings, wherein.

DETAILED DESCRIPTION OF THE INVENTION

Figure 1:
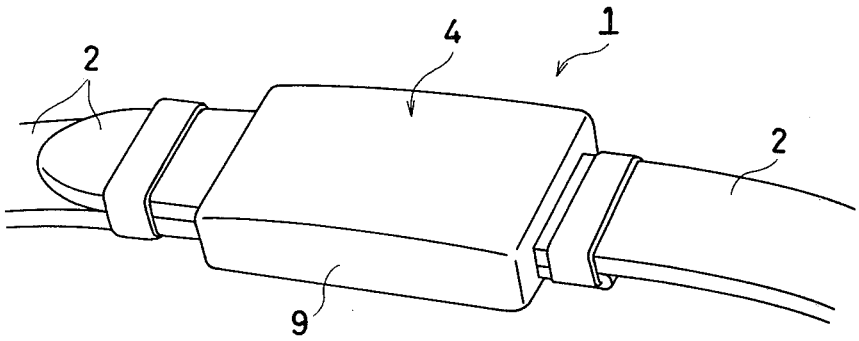
FIG. 1 is a perspective view of a belt with a buckle embodying the invention.

Referring to the accompanying drawings, a buckle 1 comprises a base 3 to which one end of a belt 2 is secured, an ornamental cover 4 rotatably mounted on the base 3, an attaching plate 5 rotatably fixed to the cover 4 at the opposite position to the base 3, and an adjusting belt 6 secured to the attaching plate 6 at its free end. A number of holes 7 are provided at a tongue of the belt 2. A projection 8 is formed on the upper side of base 3. A pair of shafts are provided at the end opposite to the end to which the belt is secured so as to protrude from the opposite sides of the base. The projection 8 is shaped in the form of a column or mashroom whose head is expanded. The ornamental cover 4 has a pair of sides 9 bent downward so as to cover the base 3. Bearings 10 are provided on the insides of both sides 9 so as to receive the shafts of base 3 in such a manner that the cover may be rotatably mounted on the base. The attaching plate 5 is fixed rotatably to the sides 9 of the cover at the opposite position to the base 3. Secured to the attaching plate 5 is the adjusting belt 6 having a thickness nearly equal to that of the belt and a length much smaller than that of the belt. When the belt is used, the head of projection 8 abuts against the inside of cover 4 and the junction of base 3 and belt 2 comes to the position opposite to the adjusting belt 6. Ornament can be provided on the surface of the top and sides 9 of the cover 4 to give the buckle a beautiful appearance.

Figure 2:
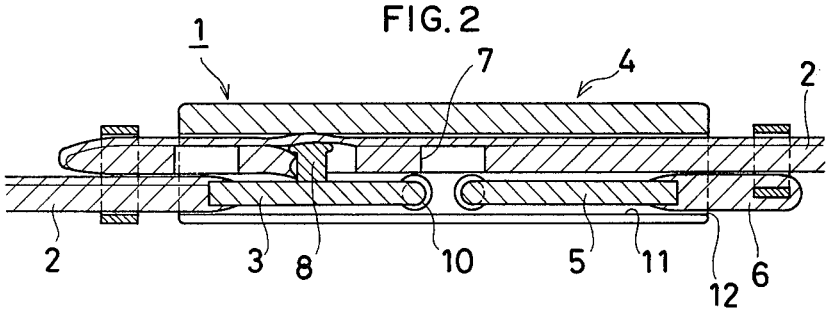
FIG. 2 is a longitudinal section of the above embodiment.
Figure 3:
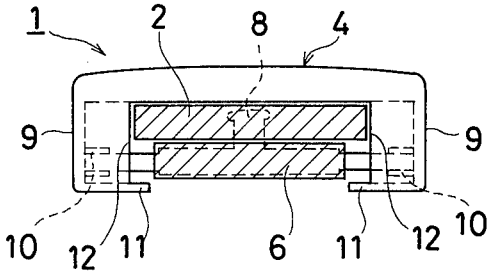
FIG. 3 is a side view of the above embodiment as viewed from the right-hand side in FIG. 1.

The width of cover 4 is made larger than the width of belt 2. The width of base 3 is made smaller than the width of belt 2 so that the sides 9 of cover 4 may be bent inward to such an extent that the base can turn between them so as to form a pair of belt holding flanges 11, which prevent the belt from falling out of the cover when the belt tongue is inserted into the buckle. When these belt holding flanges are provided, the end portion of belt 2 to be attached to the base 3 should be reduced in width so that the belt 2 can turn between the flanges along with the base. Provided at the right-hand side of cover 4 in FIG. 2 is a front side 12 having an opening of such a size that the belt can just pass through. When the width of the buckle is made much larger than that of the belt, any large gap made between the buckle and the belt can be eliminated by this front side, and ornament can be provided on this front side, too.

Figure 6:
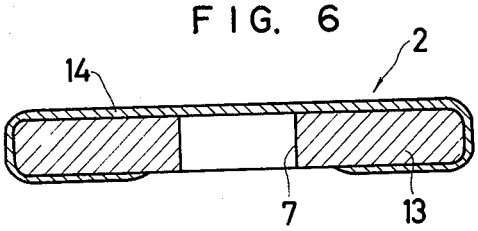
FIG. 6 is a cross section of the belt.
Figure 7:
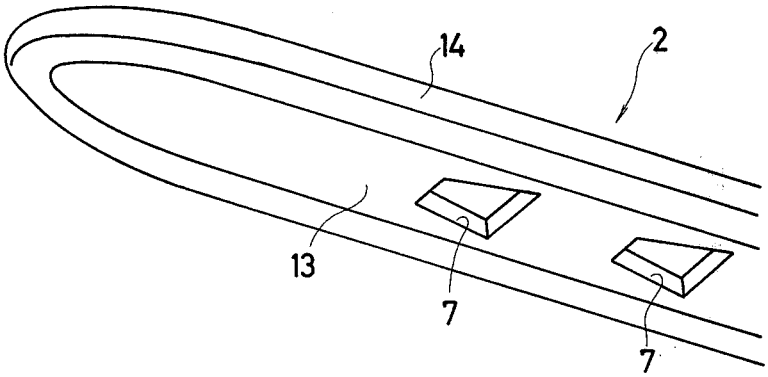
FIG. 7 is a perspective view of the belt tongue.

As shown in FIG. 6, the belt 2 comprises a core material 13 and a skin 14 covering one surface of the core material. The holes 7 provided on the tongue of belt 2 are opened only through the core material 13 so as to have no openings on the surface but on the back side of belt 2. Alternatively, two layers of leather can simply be laminated to form a belt, with holes opened only through the back leather so that the holes having no openings on the surface. With such a two-layer structure, the expanded head of projection 8 fitted into a hole of the belt 2 gets in between the skin 14 and the core material 13 or the back leather as shown in FIG. 2, thus assuring the secure engagement of belt 2 with the buckle 1. The shape of holes 7 can correspond to the shape of the head of projection 8 to be fitted thereinto. However, as shown in FIG. 7, the preferred shape is an elongated opening whose width becomes narrower toward the free end of belt 2. With such a shape, not only is insertion of the projection 8 into a hole made easier, but also its engagement is more secure since the hole firmly holds the projection as the belt is tightened.

Figure 4:
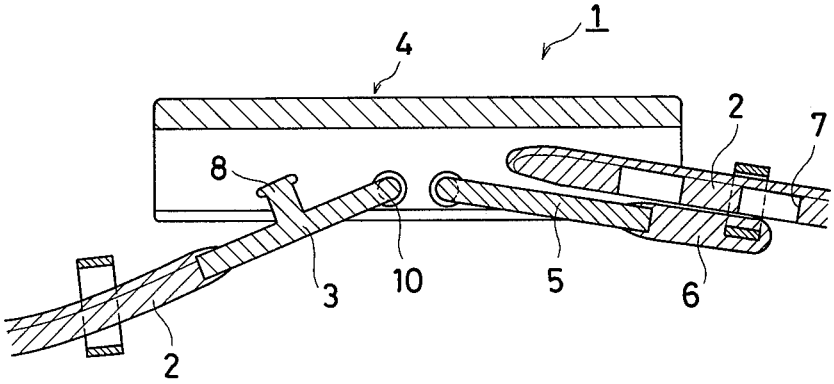
FIG. 4 is a longitudinal section showing insertion of the belt tongue into the buckle.
Figure 5:
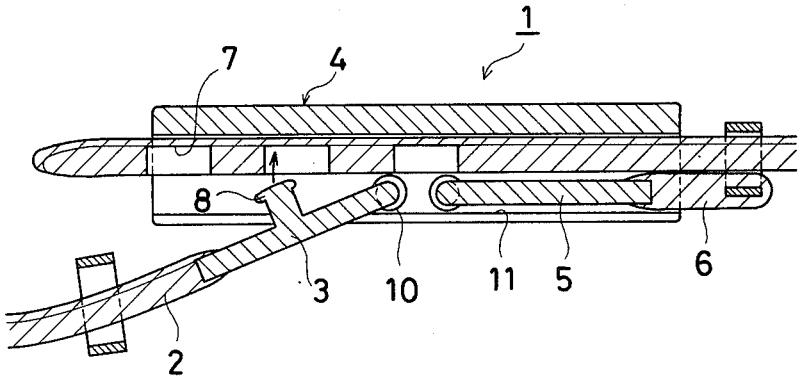
FIG. 5 is a longitudinal section showing how to remove the belt tongue from the buckle.

In operation, as shown in FIG. 4, the cover 4 is raised from the base 3, and the attaching plate 5 and adjusting belt 6, and the tongue of belt 2 is inserted from the opening provided at the side on which the adjusting belt 6 is provided, passed through the space made between the backside of cover 4, and the base 3 and adjusting belt 6, and pushed out of the opening provided on the opposite side. The cover 4 is then lowered so as to cover the base 3 in such a manner that the head of projection 8 may be fitted into a proper hole 7 thereby to tighten the belt. Next, as shown in FIG. 5, in order to loosen or undo the belt, the cover 4 is raised from the base 3 while the projection 8 is removed from the hole 7 and then the tongue of belt 2 is pulled out of the cover 4.

As described above, one of the advantages of the belt of the invention is that the belt 2 can easily be tightened or loosened simply raising the cover 4 from the base 3. Other advantages are as follows:

Since the projection 8 formed on the surface of base 3 is fitted into a hole 7 from the back side of belt 2, the holes 7 cannot be seen from the front when the belt is used. The ornamental cover 4 covers the base 3, thus giving a beautiful appearance to the buckle.

As shown in FIG. 2, with the adjusting belt 6, the surface of cover 4 can be held in parallel with the surface of belt 2, thus eliminating such any instability that the edge of cover 4, out of which the tongue of belt 2 comes, protrudes upward.

If the cover 4 is provided with the belt holding flanges 11, not only the cover will not fall out of the belt 2, but the projection 8 can be removed from the hole 7 simply by raising the cover 4 since the belt 2 is held by the cover 4, thus making it unnecessary to pull the tongue of belt 2 so as to turn the cover 4 in such a manner that the projection 8 may get out of the hole 5.

If the cover 4 is provided with the front side 12, the buckle 1 can have a more beautiful appearance than ever before since the cover 4 can hide the base 3 without any gap.

What is claimed is:

1. A belt with a buckle, which comprises a belt having a plurality of holes provided at proper intervals on its back side at its free end, each of said holes having an opening only on the back side of said belt, a base having a projection provided on its upper surface, to the left-hand end of which the other end of said belt is secured, a cover having a pair of sides bent downward, said cover being rotatably mounted on said base in such a manner that the head of said projection may abut against the back side of said cover and that the junction of said belt and said base may be positioned at the left-hand end on the back-side of said cover, and an adjusting belt having the same thickness as that of said belt, said adjusting belt being rotatably attached to said sides of said cover opposite to said base.

2. A belt with a buckle as claimed in claim 1, wherein the width of said base is made smaller than the width of said belt, and each of said sides of said cover is bent inward to form a pair of flanges for holding said belt in such a manner that said base may be freely rotatable between said flanges.

3. A belt with a buckle as claimed in claim 1 or 2, wherein said cover is provided with a front side having an opening whose dimensions are such that said belt may pass through said opening without any substantial gap therebetween.

4. A belt with a buckle as claimed in any of claims 1, 2, and 3, wherein said belt is composed of two layers of materials.

* * * * *